US005946649A

United States Patent [19]

Javkin et al.

[11] Patent Number: 5,946,649

[45] **Date of Patent: *Aug. 31, 1999**

[54] ESOPHAGEAL SPEECH INJECTION NOISE DETECTION AND REJECTION

[75] Inventors: Hector Raul Javkin, Goleta; Michael Galler, Santa Barbara; Nancy Niedzielski, Goleta; Robert Boman, Thousand Oaks, all of Calif.

[73] Assignee: Technology Research Association of Medical Welfare Apparatus, Tokyo, Japan

[ * ] Notice: This patent is subject to a terminal disclaimer.

[21] Appl. No.: 08/843,452

[22] Filed: Apr. 16, 1997

[51] Int. Cl.[6] ..... G10L 3/02

[52] U.S. Cl. ..... 704/203; 704/270; 704/255; 704/233; 704/208

[58] Field of Search ..... 704/200, 257, 704/255, 256, 254, 203, 233, 215, 206, 207, 208, 209, 210

[56] References Cited

U.S. PATENT DOCUMENTS

| | | | |
|---|---|---|---|
| 4,308,861 | 1/1982 | Kelly | 606/204 |
| 4,489,440 | 12/1984 | Chaoui . | |
| 4,589,136 | 5/1986 | Poldy et al. . | |
| 4,627,095 | 12/1986 | Thompson . | |
| 4,718,099 | 1/1988 | Hotvet . | |
| 4,736,432 | 4/1988 | Cantrell . | |
| 4,837,832 | 6/1989 | Fanshel . | |
| 4,862,506 | 8/1989 | Landgarten et al. . | |
| 4,896,358 | 1/1990 | Bahler et al. . | |
| 5,097,509 | 3/1992 | Lennig | 704/240 |
| 5,157,653 | 10/1992 | Genter | 370/288 |
| 5,319,703 | 6/1994 | Drory | 704/203 |
| 5,326,349 | 7/1994 | Baraff | 623/9 |
| 5,359,663 | 10/1994 | Katz . | |
| 5,511,009 | 4/1996 | Pastor . | |
| 5,621,850 | 4/1997 | Kane et al. | 704/206 |
| 5,630,015 | 5/1997 | Kane et al. | 704/209 |
| 5,710,862 | 1/1998 | Urbanski | 704/208 |

OTHER PUBLICATIONS

Article by Bernd Weinberg and James F. Bosma entitled "Similarities Between Glossopharyngeal Breathing and Injection Methods of Air Intake for Esophageal Speech" in the Journal of Speech and Hearing Disorders, vol. XXXI, No. 1, 1970.

Article by Leonard E. Baum entitled "An Inequality and Associated Maximization Technique in Statistical Estimation for Probabilistic Functions of Markov Processes" published by Institute for Defense Analyses, Princeton, NJ, 1972.

(List continued on next page.)

*Primary Examiner*—David R. Hudspeth
*Assistant Examiner*—Abul K. Azad
*Attorney, Agent, or Firm*—Price Gess & Ubell

[57] ABSTRACT

The present invention eliminates injection noise in speech produced by esophageal speakers. A speech input signal is digitized. One copy of the digitized signal is used for analysis and the other is passed through a gain switch to an amplifier as output. A Fast Fourier Transform and a mean value of the digitized speech input signal is calculated. The Fast Fourier Transform (FFT) is passed through a morphological filter to produce a filtered spectrum. An occurrence of injection noise is detected by calculating a derivative of the filtered spectrum and determining from the mean value and the derivative a location and value of a largest peak and a second largest peak in the filtered spectrum. If the largest peak is lower in frequency than the second largest peak, and if all points above 2 KHz are less than the mean, then an occurrence of injection noise has been detected. An occurrence of silence is detected by center-clipping the filtered spectrum and determining whether there is any energy within a sliding 10 millisecond window for a predetermined amount of time. If no energy is detected within a sliding 10 millisecond window for a predetermined amount time, then an occurrence of silence has been detected. The output speech signal is passed after the occurrence of injection noise has been detected; and is blocked following an occurrence of silence.

15 Claims, 4 Drawing Sheets

OTHER PUBLICATIONS

Article by G. David Forney, Jr., entitled "The Viterbi Algorithm" published in the Proceedings of the IEEE, vol. 61, No. 3, Mar. 1973.

Article by Frederick Jelinek entitled "Continuous Speech Recognition by Statistical Methods" published in the Proceedings of the IEEE, vol. 64, vol. 4, Apr. 1976.

Article by Steven B. Davis and Paul Mermelstein entitled "Comparison of Parametric Representations for Monosyllabic Word Recognition in Continuously Spoken Sentences" published in IEEE Transactions on Acoustics, Speech and Signal Processing, vol. ASSP–28, No. 4, Aug. 1980.

Article by Joanne Robbins, Hilda B. Fisher, Eric C. Blom and Mark I. Singer entitled "A Comparative Acoustic Study of Normal Esophageal, and Tracheoesophageal Speech Production" published in the Journal of Speech and Hearing Disorders, vol. 49, 202–210, May 1984.

Article by Yingyong Qi entitled "Replacing Tracheoesophageal Voicing Sources Using LPC Synthesis" published in the Journal of Acoustical Society of America 88:1228–1235, 1990.

I. Pitas and A. N. Venetsanopoulos publication of "Nonlinear Digital Filters" by Kluwer Academic Publishers, Jun. 5, 1990.

Hong C. Leung, Benjamin Chigier and James R. Glass article entitled "A Comparative Study of Signal Representations and Classification Techniques for Speech Recognition" Proc. I CASSP–93, pp. II–680 to II–683, 1993.

John H. L. Hansen article entitled "Morphological Constrained Feature Enhancement with Adaptive Cepstral Compensation (MCE–ACC) or Speech Recognition in Noise and Lombard Effect" published in IEEE Transactions On Speech And Audio Processing, vol. 2, No. 4, Oct. 1994.

Article by Yingyong Qi, Bernd Weinberg and Ning Bi entitled "Enhancement of Female Esophageal and Tracheoesophageal Speech" published in the Journal of Acoustical Society of America, 98(5), P. 1, Nov. 1995.

ESOPHAGEAL SPEECH INJECTION NOISE DETECTION AND REJECTION

BACKGROUND OF THE INVENTION

1. Field of the Invention

The present invention relates generally to the field of esophageal speech, and more particularly, to a method for enhancing the clarity of esophageal speech.

2. Description of Related Art

Persons who have had laryngectomies have several options for the restoration of speech, none of which have proven to be completely satisfactory. One relatively successful method, esophageal speech, requires speakers to insufflate, or inject air into the esophagus. This method is discussed in the article "Similarities Between Glossopharyngeal Breathing And Injection Methods of Air Intake for Esophageal Speech," Weinberg, B. & Bosna, J. F., J. *Speech Hear Disord,* 35: 25–32, 1970, herein incorporated by reference. Esophageal speech is frequently accompanied by an undesired audible injection noise, sometimes referred to as an "injection gulp." The undesirable effect of the injection gulp is magnified because esophageal speakers generally have low vocal intensity and therefore require some form of external amplification. A further discussion of these effects may be found in the article "A Comparative Acoustic Study of Normal, Esophageal, and Tracheoespphageal Speech Production," Robbins, J., Fisher, H. B., Blom, E. C., and Singer, M. I., *J. Speech Hear Res,* 49: 202–210, 1984, herein incorporated by reference. The audible injection noise is undesirable for at least two reasons. First, listeners and speakers find the noise objectionable. Also, in some speakers the injection noise can be mistaken for a speech segment which diminishes the intelligibility of the speaker's voice.

Considerable work has been undertaken to enhance certain aspects of esophageal speech. Examples of these techniques are discussed in "Replacing Tracheoesophageal Voicing Sources Using LPC Synthesis," Qi, Y., *J. Acoust. Soc. Am.,* 88: 1228–1235, and in "Enhancement of Female Esophageal and Tracheoesophageal Speech," Qi, Y., Weinberg, B. and Bi, N., *J. Acoust. Soc. Am.,* 98: 2461–2465, both herein incorporated by reference. Although considerable work has been done in improving esophageal speech, the problem of eliminating injection noise has not been successfully addressed by the above-mentioned prior art.

One solution is disclosed by U.S. patent application Ser. No. 08/773,638, filed Dec. 23, 1996, entitled "ENHANCEMENT OF ESOPHAGEAL SPEECH BY INJECTION NOISE REJECTION." This application is commonly assigned to the assignee of the present invention. This application discloses a method of eliminating the undesirable auditory effects associated with esophageal speech. Injection noise and silence are detected in an input speech signal, and an external amplifier is switched on or off, based on the detected injection noise or silence. The input speech signal is digitized and a first copy of the digitized signal is preemphasized. After the input speech signal is preemphasized, a predetermined number of Mel-frequency cepstral coefficients (MFCCs) and difference cepstra are calculated for each window of the speech signal. A measure of signal energy and a measure of the rate of change of the signal energy is computed.

A second copy of the digitized input speech signal is processed using amplitude summation or by differencing a center-clipped signal. The measures of signal energy, rate of change of the signal energy, the Mel coefficients, difference cepstra, and either the amplitude summation value or the differenced value are combined to form an observation vector. Hidden Markov Model (HMM) based decoding is used on the observation vector to detect the occurrence of injection noise or silence. A gain switch on an external speech amplifier is turned on after an occurrence of injection noise and remains on for the duration of speech and the amplifier is turned off when an occurrence of silence is detected.

The present invention is an improved and unique method for detecting injection noise and silence in esophageal speech, and amplifying only the desired speech.

SUMMARY OF THE INVENTION

The present invention eliminates injection noise in speech produced by esophageal speakers. A speech input signal is digitized. One copy of the digitized signal is used for analysis and the other is passed through a gain switch to an amplifier as output. A Fast Fourier Transform of the digitized speech input signal is calculated. The Fast Fourier Transform (FFT) is passed through a morphological filter to produce a filtered spectrum. An occurrence of injection noise is detected by calculating a mean FFT value over the whole signal and a derivative of the filtered spectrum. From the mean value and the derivative, a location and value of a largest peak and a second largest peak in successive windows of the filtered spectrum are determined. If the largest peak is lower in frequency than the second largest peak, and if all points above 2 KHz are less than the mean, then an occurrence of injection noise has been detected.

An occurrence of silence is detected by center-clipping the filtered spectrum and determining whether there is any energy within a sliding 10 millisecond window for a predetermined amount of time. If no energy is detected within a sliding 10 millisecond window for a predetermined amount time, then an occurrence of silence has been detected. The output speech signal is passed after the occurrence of injection noise has been detected; and is blocked following an occurrence of silence.

BRIEF DESCRIPTION OF THE DRAWINGS

The exact nature of this invention, as well as its objects and advantages, will become readily apparent from consideration of the following specification as illustrated in the accompanying drawing, and wherein:

FIG. 2(*b*) is a graph showing the result of passing the FFT of the injection noise segment through a morphological filter;

FIG. 3(*b*) is a graph showing the result of passing the FFT of the /d/ segment through a morphological filter;

DESCRIPTION OF THE PREFERRED EMBODIMENTS

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide an improved method for rejecting injection noise based on the recognition of silence and injection gulps.

Figure 1:
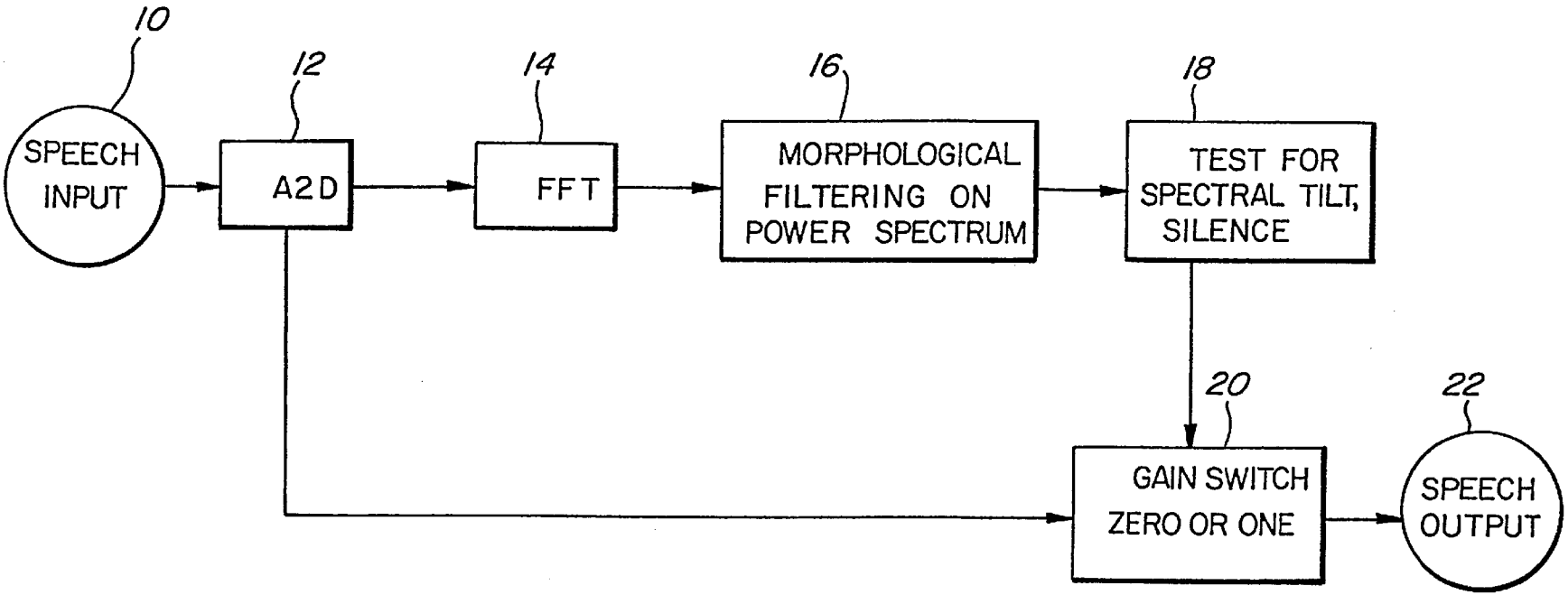
FIG. 1 is a block diagram of the method of the present invention.

In esophageal speech, air injection is required prior to the start of every utterance, and typically occurs after every pause, before an utterance continues. By using digital processing techniques to detect an injection gulp, it is possible to switch an external voice amplification apparatus on only after the injection noise has occurred, and switch amplification off after a period of silence. Normal speech is transmitted without interruption. This method results in real time amplification of the voice signal, without amplifying an injection gulp. The method of the present invention will now be described in detail with reference to FIG. 1.

An analog speech input signal 10 is digitized at step 12 by an analog to digital converter. In the preferred embodiment, a 20 KHz sampling rate is used, although other rates may be used with satisfactory results. One copy of the digitized signal is used for analysis, and a second copy of the digitized signal is sent to a gain control switch at step 20, the operation of which is described below.

The analysis of the speech signal to determine injection noise is based on the observation that the noise, which is produced by a gesture with a closed vocal tract, has a strong, low-frequency emphasis. This characteristic appears to be due to a double closure in the vocal tract of many esophageal speakers, which strongly attenuates high frequencies.

Figure 4:
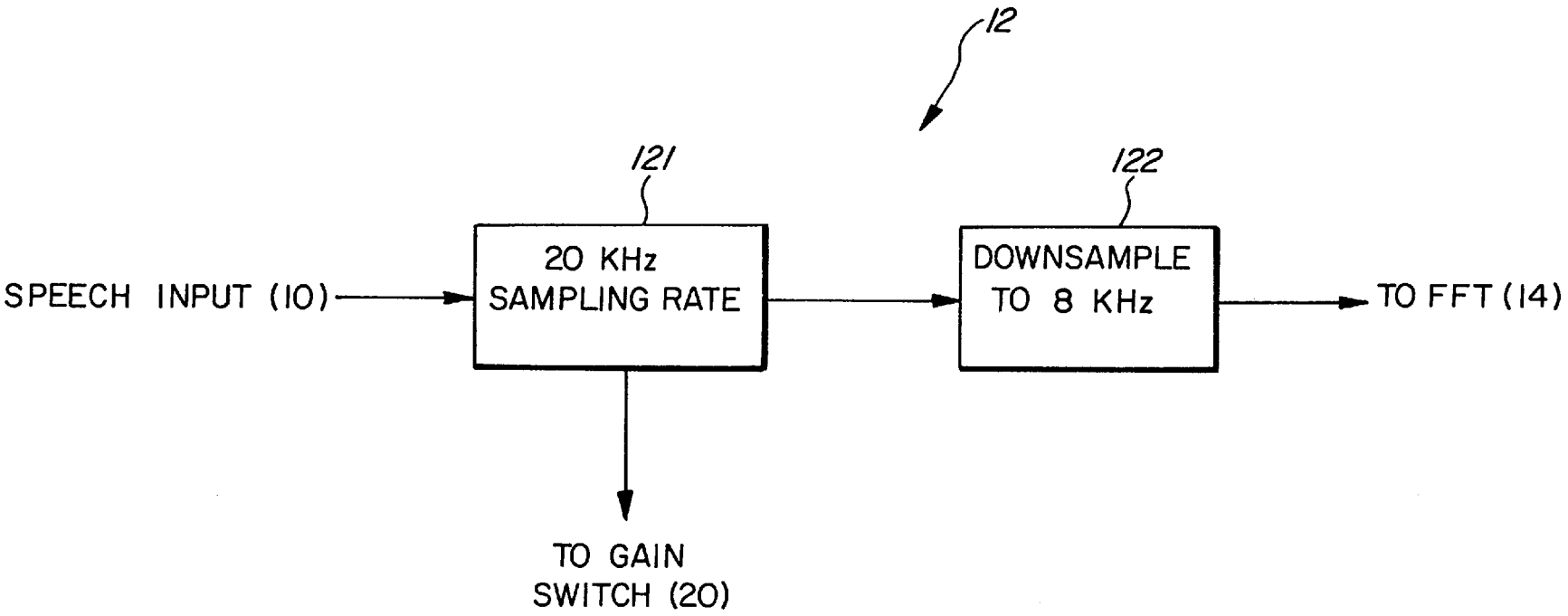
FIG. 4 shows step 12 of FIG. 1 in greater detail.

The digitized speech input signal 121 used for analysis is further downsampled to 8 KHz., as shown at step 122 in FIG. 4. Using this slower sampling rate provides sufficient information for analysis, while improving the processing speed of the method. A 256-point Fast Fourier Transform (FFT) is computed every 10 milliseconds (ms) at step 14. The FFT is transformed using a morphological filter with a 10-point wide sliding window at step 16. This processing removes all but the gross features of the spectral curve. Morphological filtering is discussed in *Nonlinear Digital Filters*, Pitas, L. and Venetsanopoulos, A. N., Kluwar Academic Publishers, Boston, 1990 and in "Morphological Constrained Feature Enhancement with Adaptive Cepstral Compensation (MCE-ACC) for Speech Recognition in Noise and Lombard Effect," Hansen, J. H. L., IEEE Trans. SAP, vol. 2, pp. 598–614, 1994, both herein incorporated by reference.

Figure 2A:
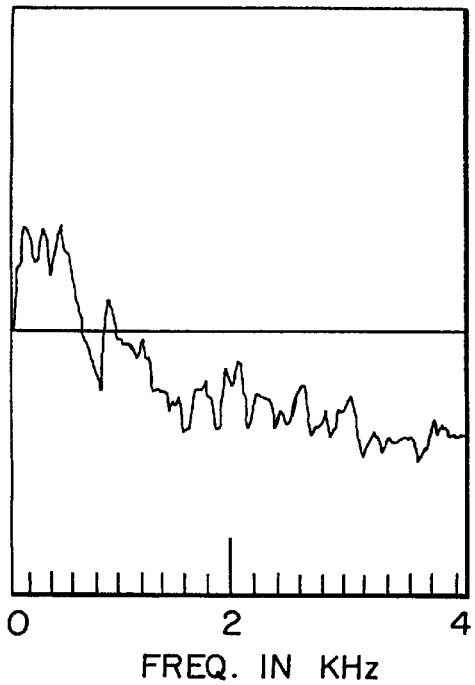
FIG. 2(*a*) is a graph showing a 256-point Fast Fourier Transform FFT) from the center of an injection noise segment.
Figure 2B:
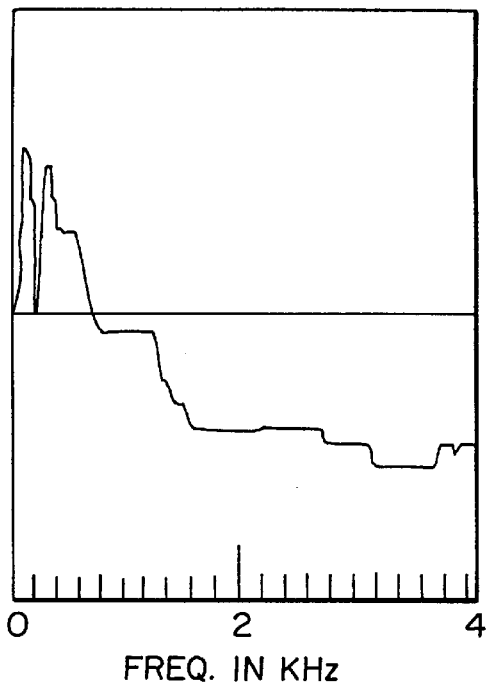
Figure 3A:
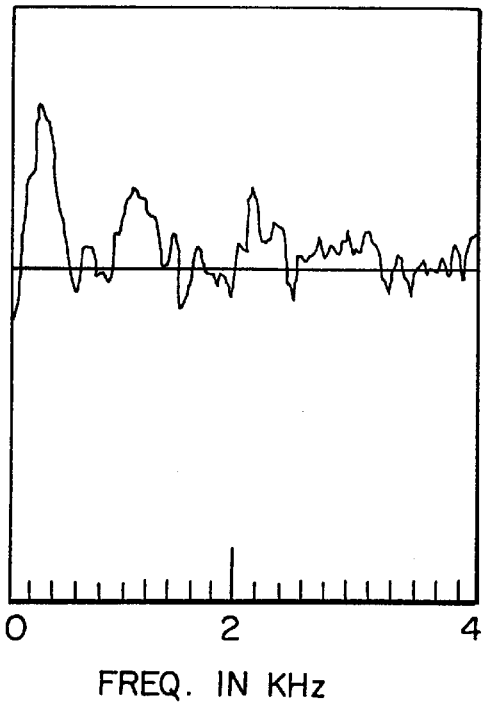
FIG. 3(*a*) is a graph showing a 256-point FFT from the center of a /d/ segment.
Figure 3B:
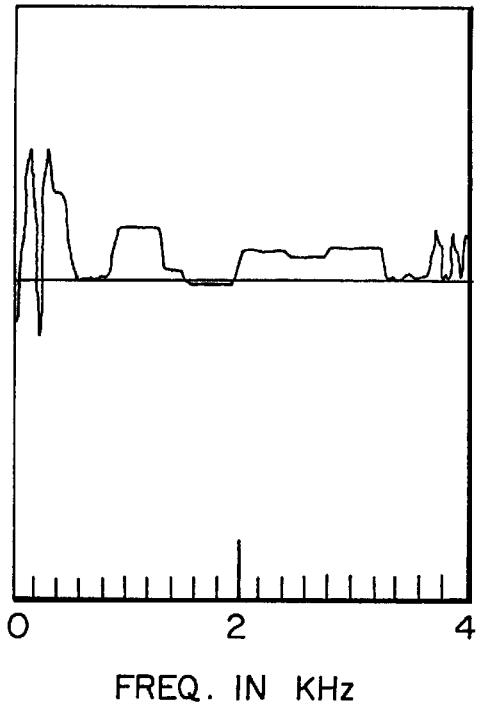

FIG. 2(*a*) shows a magnitude spectrum (256-point FFT) from the center of an injection noise segment and FIG. 2(*b*) shows the output of the FFT passed through the morphological filter. The speech segments which have the greatest potential to be confused with injection nose when spoken by esophageal speakers are voiced stops such as /b/, /d/, or /g/. FIG. 3(*a*) shows a magnitude spectrum (256-point FFT) from the center of the consonant /d/ and FIG. 3(*b*) shows the output of the FFT passed through the morphological filter.

Figure 5:
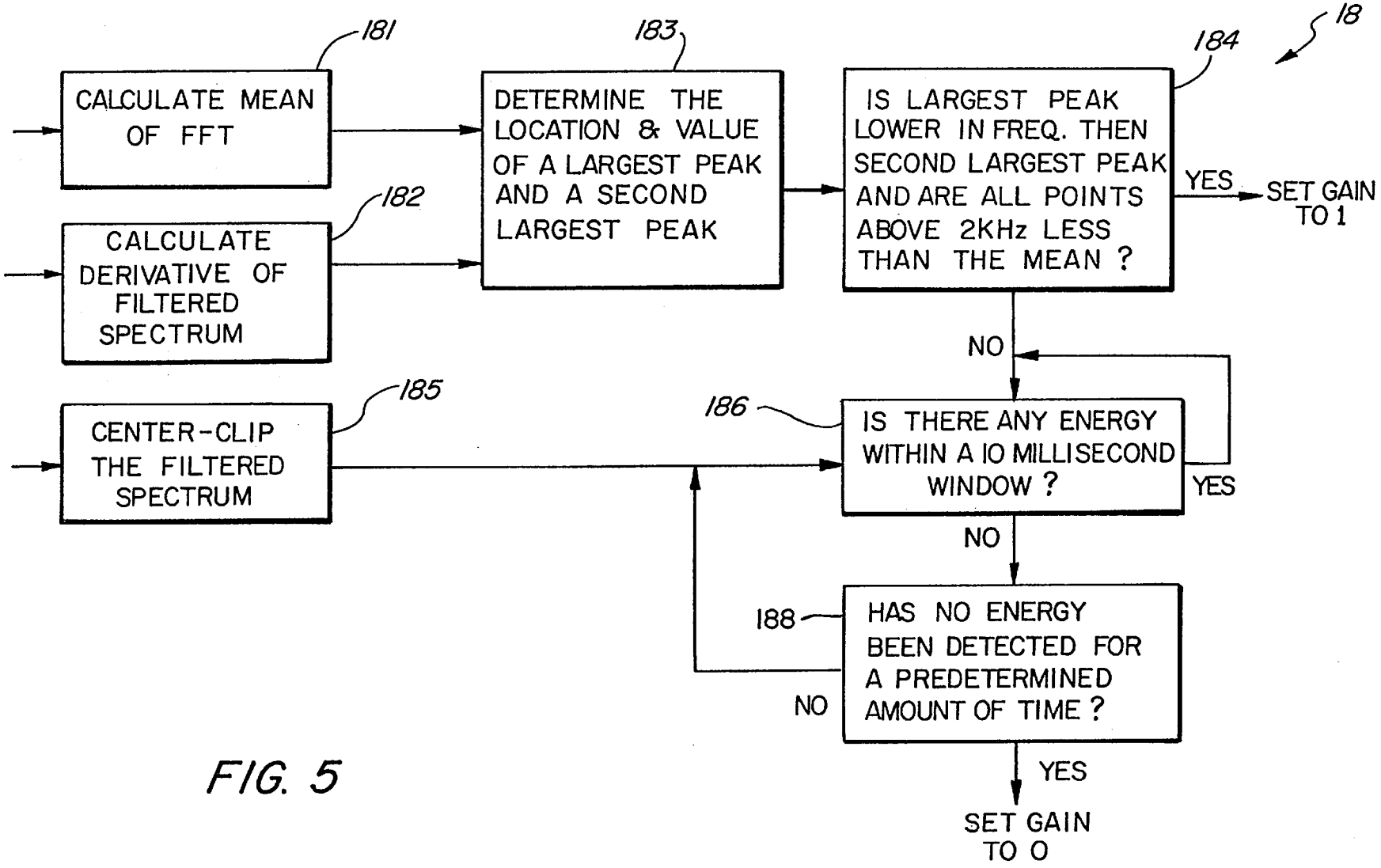
FIG. 5 shows step 18 of FIG. 1 in greater detail.

The output of the morphological filter is then used to determine an occurrence of an injection gulp or silence at step 18. FIG. 5 illustrates a preferred embodiment of step 18 according to the present invention. The mean FFT value for the whole signal 181 and the derivative 182 of the filtered spectrum are computed and the location and value of the two largest peaks are identified at step 183. A signal segment is identified as injection noise if the following criteria are met at step 184:

a) The largest peak is lower in frequency than the second largest peak; and b) All points above 2 KHz are less than the mean. If these two conditions are met, then an injection gulp has been detected and the gain switch 20 is set to "1" (amplify). If, however, these conditions are not met, then the silence determination, operating in parallel, determines when to shut off the gain switch 20. The spectrum is center-clipped 185 and a determination is made whether there is any energy within a 10 millisecond window at step 186. If there is energy within the window, then silence has not been detected. If there is no energy within the 10 millisecond window, for a predetermined amount of time, then the gain switch 20 is set to "zero" (off). In a preferred embodiment, if there is no energy detected for a period of at least 150 milliseconds 188, then the gain switch 20 is turned off. The amount of time of the silence period may be adjusted as required for individual speakers.

Since esophageal speakers produce an injection noise event prior to each speech segment, amplification is initially set at zero. Once an injection noise event has been detected, amplification is set to unity gain at step 20. Silence detection is accomplished by center-clipping the signal, and testing for any energy within a 10 ms window for a predetermined amount of time. The silence determination is aided by the use of a close-talking microphone which prevents extraneous noise from interfering with the determination.

The present invention detects esophageal injection noise about 85% of the time in initial tests. It is also useful in detecting injection noise for use in teaching esophageal speakers. The method may also be extended for use in detecting other speech/non-speech distinctions, and in detecting distinctions between speech sound in speech recognition applications.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method for detecting and rejecting injection noise in a speech signal, wherein the injection noise is a result of using esophageal speech, the method comprising the steps of:

processing the speech signal;

detecting an occurrence of injection noise and an occurrence of silence in the processed speech signal;

passing the speech signal after the occurrence of injection noise has been detected; and blocking the speech signal after an occurrence of silence.

2. The method of claim 1, wherein the step of processing the speech signal comprises the steps of:

digitizing the speech input signal;

calculating a Fast Fourier Transform (FFI) and a mean value of the digitized speech input signal;

passing the Fast Fourier Transform (FFT) through a morphological filter to produce a filtered spectrum;

calculating a derivative of the filtered spectrum; and determining from the mean and the derivative a location and value of a largest peak and a second largest peak in the filtered spectrum.

3. The method of claim 2, wherein the step of determining an occurrence of injection noise comprises the steps of:

determining if the largest peak is lower in frequency than the second largest peak; and determining if all points above 2 KHz are less than the mean.

4. The method of claim 3 wherein the step of determining an occurrence of silence comprises the steps of:

center-clipping the filtered spectrum;

determining if there is any energy within a sliding 10 millisecond window for a predetermined amount of time.

5. The method of claim 4, wherein an amplifier is switched on after an occurrence of injection noise has been detected and is switched off when silence is detected for the predetermined amount of time.

6. The method of claim 5, wherein the step of digitizing the input signal comprises the steps of:

sampling the input signal at a rate of 20 KHz, and providing the 20 KHz signal to the amplifier; and downsampling the 20 KHz signal to an 8 KHz analysis signal before calculating the Fast Fourier Transform (FFT).

7. The method of claim 6, wherein the Fast Fourier Transform (FFT) is a 256-point Fast Fourier Transform (FFT) calculated every 10 milliseconds.

8. The method of claim 7, wherein the morphological filter has a 10 point sliding window.

9. The method of claim 8, wherein the predetermined amount of time is 150 milliseconds.

10. A method for detecting and rejecting injection noise in a speech input signal, wherein the injection noise is a result of using esophageal speech, the method comprising the steps of:

digitizing the speech input signal;

calculating a Fast Fourier Transform (FFT) and a mean value of the digitized speech input signal;

passing the Fast Fourier Transform (FFT) through a morphological filter to produce a filtered spectrum;

detecting an occurrence of injection noise, the step of detecting an occurrence of injection noise further comprises the steps of:

calculating a derivative of the filtered spectrum; determining from the mean and the derivative a location and value of a largest peak and a second largest peak in the filtered spectrum;

determining if the largest peak is lower in frequency than the second largest peak; and determining if all points above 2 KHz are less than the mean, wherein if the largest peak is lower in frequency than the second largest peak and if all points above 2 KHz are less than the mean, then an occurrence of injection noise has been detected;

detecting an occurrence of silence, the step of detecting an occurrence of silence further comprises:

center-clipping the filtered spectrum; and determining if there is any energy within a sliding 10 millisecond window for a predetermined amount of time, wherein if no energy is detected within a sliding 10 millisecond window for a predetermined amount time, then an occurrence of silence has been detected;

passing the speech signal after the occurrence of injection noise has been detected; and blocking the speech signal after an occurrence of silence.

11. The method of claim 10, wherein an amplifier is switched on after an occurrence of injection noise has been detected and is switched off when silence is detected for the predetermined amount of time.

12. The method of claim 11, wherein the step of digitizing the input signal comprises the steps of:

sampling the input signal at a rate of 20 KHz, and providing the 20 KHz signal to the amplifier; and downsampling the 20 KHz signal to an 8 KHz analysis signal before calculating the Fast Fourier Transform (FFT).

13. The method of claim 12, wherein the Fast Fourier Transform (FFT) is a 256-point Fast Fourier Transform (FFT) calculated every 10 milliseconds.

14. The method of claim 13, wherein the morphological filter has a 10 point sliding window.

15. The method of claim 14, wherein the predetermined amount of time is 150 milliseconds.

* * * * *